US011236942B2

(12) United States Patent
Christ

(10) Patent No.: US 11,236,942 B2
(45) Date of Patent: Feb. 1, 2022

(54) FREEZE-DRYING APPARATUS WITH A LOADING AND UNLOADING DEVICE

(71) Applicant: Martin Christ Gefriertrocknungsanlagen GmbH, Osterode (DE)

(72) Inventor: Martin Christ, Osterode (DE)

(73) Assignee: MARTIN CHRIST GEFRIERTROCKNUNGSANLAGEN GMBH, Osterode (DE)

( * ) Notice: Subject to any disclaimer, the term of this patent is extended or adjusted under 35 U.S.C. 154(b) by 1851 days.

(21) Appl. No.: 14/345,913

(22) PCT Filed: Nov. 3, 2012

(86) PCT No.: PCT/EP2012/004595
§ 371 (c)(1),
(2) Date: Mar. 19, 2014

(87) PCT Pub. No.: WO2013/064266
PCT Pub. Date: May 10, 2013

(65) Prior Publication Data

US 2014/0230265 A1 Aug. 21, 2014

(30) Foreign Application Priority Data

Nov. 4, 2011 (DE) ..... 1020111176288

(51) Int. Cl.
*F26B 25/00* (2006.01)
*F26B 5/06* (2006.01)

(52) U.S. Cl.
CPC ..... *F26B 25/001* (2013.01); *F26B 5/06* (2013.01)

(58) Field of Classification Search
CPC ..... F26B 25/001; F26B 5/06; B65G 25/06; B65G 25/08; B65G 25/04; B65G 25/00
(Continued)

(56) References Cited

U.S. PATENT DOCUMENTS 4,781,067 A * 11/1988 Cichanski ..... G10K 11/352 250/363.08
5,014,583 A * 5/1991 Webb ..... B23D 47/042 83/276

(Continued)

FOREIGN PATENT DOCUMENTS

DE 10307571 A1 9/2004
DE 602004003962 T2 10/2007

(Continued)

OTHER PUBLICATIONS

International Search Report; dated Feb. 8, 2013; EPO.

*Primary Examiner* — Jorge A Pereiro
*Assistant Examiner* — Bao D Nguyen
(74) *Attorney, Agent, or Firm* — Thomas | Horstemeyer, LLP

(57) ABSTRACT

A freeze-drying apparatus (1) includes an arrangement of individual product platforms (19) that are supported vertically in a frame (20) in a drying chamber, in which each platform is able to be moved to a shift level, in which lateral guides (20, 21) designed to support a carriage (15) are arranged with a fixed height position, and which cooperate with the guides (16, 18) of a loading and unloading device. All product platforms (19) in the drying chamber can be loaded by repeating this operation cyclically. In order to unload the drying chamber, the arrangement of the product platforms (19) are moved to such a position above the shift level in which the carriage (15) can be moved as far as its rear limit position inside the drying chamber, travelling underneath each loaded product platform (19).

20 Claims, 17 Drawing Sheets

(58) Field of Classification Search
USPC ..... 34/284, 92
See application file for complete search history.

(56) References Cited

U.S. PATENT DOCUMENTS

| | | | | |
|---|---|---|---|---|
| 5,129,162 | A | 7/1992 | Hemmersbach et al. | |
| 7,695,230 | B2 | 4/2010 | Selch | |
| 2004/0194655 | A1 | 10/2004 | Insana et al. | |
| 2006/0016094 | A1* | 1/2006 | Covert | F26B 25/001 34/217 |
| 2009/0025251 | A1* | 1/2009 | Wagner | F26B 5/06 34/573 |
| 2010/0070108 | A1* | 3/2010 | Kluetsch | F26B 5/06 701/2 |
| 2011/0088328 | A1 | 4/2011 | Schaff | |
| 2012/0159803 | A1* | 6/2012 | Van Veen | F26B 5/06 34/284 |
| 2012/0186947 | A1 | 7/2012 | Christ | |

FOREIGN PATENT DOCUMENTS

| | | | |
|---|---|---|---|
| DE | 102007034197 | A1 | 1/2009 |
| DE | 202008012379 | U1 | 1/2009 |
| EP | 0391208 | A1 | 3/1990 |
| FR | 2918653 | A1 | 7/2013 |
| WO | 2005121671 | A1 | 12/2005 |
| WO | 2011015453 | A1 | 2/2011 |
| WO | 2011045008 | A1 | 4/2011 |

* cited by examiner

FREEZE-DRYING APPARATUS WITH A LOADING AND UNLOADING DEVICE

The instant application should be granted the priority dates of Nov. 4, 2011, the filing date of the corresponding German patent application DE 10 2011 117 628.8 as well as Nov. 3, 2012, the filing date of the International patent application PCT/EP2012/004595.

BACKGROUND OF THE INVENTION

The invention relates to a freeze-drying apparatus.

In many cases, freeze-drying plants are designed for discontinuous operation, and consist primarily of a drying chamber and a condenser chamber that communicates with the drying chamber via a closable opening, wherein the product to be dried is contained in a wide range of drying receptacles, vials, ampoules or even dishes, which are placed on a support surface inside the drying chamber for the drying process to be carried out. Inside the drying chamber, a plurality of such support surfaces are arranged one above the other at a distance from each other in a rack arrangement so as to be vertically displaceable. Depending on the size of the freeze-drying apparatus, it is possible that a large number of drying receptacles—each containing a defined quantity of goods for drying—may have to be placed inside the drying chamber for a drying process and taken out again when the process is complete, so the use of automated apparatuses both for loading and unloading the drying receptacles is commonplace, although nowadays it must be specified when drying units are ordered whether loading and/or unloading is to be carried out by hand or with the aid of suitable, automated equipment. At the moment, converting a freeze drying unit that is loaded and/or unloaded manually to an integrated, automated process is not possible, or only possible at great expense.

In view of the sensitivity to temperature of the goods to be dried, and especially because of the need to ensure absolutely aseptic conditions for all components of the unit that come into contact with the goods to be dried, the initial design of a loading and unloading device must include extremely careful consideration of the way in which the construction and mode of operation of such a device respond to the imperatives of aseptic manufacturing.

SUMMARY OF THE INVENTION

A freeze-drying system is known from WO 2005/121671 A1, in which the receptacles are transported upright on a conveyor belt to a position in front of the input opening of the system housing, and are then moved into the housing one row at a time in a direction perpendicular to the direction of advance of the conveyor belt so that drying can take place. The drying receptacles are moved using a device consisting of two carriages supported on guides extending on either side of a product platform located in a loading position, which two carriages are connected to one another by a pusher bar, wherein the pusher bar serves both to push the drying receptacles in and to push the drying receptacles out after drying is complete. For this purpose, the pusher bar may be swiveled about an axis extending parallel to the product platform between a lowered, active position, that is to say in a position for resting flush against the drying receptacles, and a raised, inactive position, that is to say in a position for passing above the drying receptacles standing on the product platform. Accordingly, in order to eject the drying receptacles, the pusher bar is first swiveled into the inactive position, advanced into the housing above the drying receptacles, and finally swiveled back into the active position thereof when it has reached the rear of the group of drying receptacles on the far side with respect to the input opening, where it is ready to push the receptacles out. This process presents difficulties because it involves travelling over the drying receptacles, particularly in terms of preserving aseptic conditions because abrasion is unavoidable.

The freeze-drying system known from DE 103 07 571 A1 is characterized in that a pusher is provided in a direction perpendicular to the direction of advance of the conveyor belt in order to push the drying receptacles initially standing upright on a conveyor belt one row at a time into the housing thereof, and a pusher bar is also provided, and is aligned parallel to the pusher and can be advanced into the housing and withdrawn therefrom by means of two chain hoists running along the sides of the product platform in the loading and unloading position. In this case too, the ends of the pusher bar can be swiveled about a horizontal axis, between a lowered, active position, that is to say in which it is designed to lie flat against the group of upright drying receptacles and a raised, inactive position, in which it is designed to travel over the group. In the same way as in the system according to WO 2005/121671 A1, the process of travelling over the drying receptacles must be considered critical. Furthermore, two separate mechanical systems and associated drive systems are required to push the drying receptacles into and out of the drying unit. This represents a not inconsiderable design engineering challenge.

Finally, a further freeze-drying system is known from DE 60 2004 003 692 T2, in which a pusher is provided that can be advanced into the housing through the input opening therein in order to push drying receptacles into the unit one row at a time, wherein the group of drying receptacles that is pushed into the housing is positioned flat against a bar that can also be advanced into the housing during the pushing process, which bar serves to stabilize the drying receptacles in the upright position. Each end of the bar is supported by a carriage and can be swiveled thereon between a lower, active position flush with the drying receptacles and an upper, inactive position designed to enable it to travel over the group of drying receptacles.

The pusher and the bar can be withdrawn completely from the housing. When the drying receptacles are pushed out, the bar functions as an ejector, whereas the pusher performs a stabilizing function. Apart from the need to travel over the drying receptacles, a disadvantage of this embodiment is the fact that two pushing mechanisms that are independent of one another, and the associated drive systems are provided, one of which can be switched between two positions, that is to say an active and inactive position.

The drawback associated with the use of a pusher bar that can be swiveled between an active and an inactive position, and which is operatively connected for example to laterally attached chain hoists or other tractive and pressing means to enable it to travel over the drying receptacles, is that additional space is required to accommodate the necessary guides therefor, which inevitably increases the dimensions of the drying chamber.

In view of the situation described in the preceding, the object of the invention is to design a freeze-drying apparatus of the type described in the introduction to such effect that aseptic conditions may be assured with a simple construction and also in simple manner when the apparatus is in operation. This object is solved with such a freeze-drying system by the features listed in the characterizing part of claim 1.

It is essential for the purposes of the invention that only one carriage is needed, the front and rear sides of which each form a movable leading edge for the drying receptacles, to assure the operation of pushing into the drying chamber and the operation of pushing out of the drying chamber. It is also essential for the purposes of the invention that the operation of advancing the carriage into the drying chamber for the purpose of bringing the front side thereof facing toward a door in the housing into the starting position for pushing the drying receptacles out, which corresponds to the extreme rear position, is always performed in conjunction with travelling below loaded product platforms. Since travelling above loaded product platforms is entirely avoided in this way, problems created by the abrasion that is inevitably associated with the movement of the carriage are prevented entirely, and aseptic conditions are thus preserved.

The advance of the carriage into the drying chamber at the start of and during the subsequent unloading of the product platforms takes place on a shift level that may be an empty product platform, the pressure plate for aligning product platforms or even the space below the pressure plate. The system movement always takes place below the product platform that is initially to be unloaded, the surface is only lowered afterwards, and this is followed by the unloading operation.

The guides designed to serve as bearings for the carriage are disposed at a fixed height and define the position of the shift level.

A conveyor belt with a direction of advance that is transverse to the input and ejection direction forms a part of the loading and unloading device.

A transport trolley, the size of which is determined by the product platform and which also has a parking position for the carriage as well as the guides described may also be used instead of a conveyor belt. Such a transport trolley does not comprise a conveyor belt.

The loading and unloading device comprises a loading stage, the guides of which cooperate with the guides inside the drying chamber to support the carriage.

With regard to the second extreme position of the carriage, located outside the drying chamber, this position may be used as a parking position during the drying operation. It is set up on the opposite side of the conveyor belt from the point of view of the drying chamber, if it is to be used at the same time for loading. In other cases it may also be set up on the loading stage.

Different variants of a drive unit for the carriage. In this context, an electric drive unit that may also be a linear drive is used. A preferably inductive charging point may be located at the second limit position for the case that the drive unit is battery-powered.

Further configurations of the drive unit, including the guides allocated thereto, are contemplated. Accordingly, a frictional connection with the guides is preferably imparted by means of a toothed belt, which passes round a number of running wheels and is thus suitable for bridging gaps in segments of the guides. It is essential for the purposes of the invention that the drive unit comprises a housing that accommodates all of the components, including a controller, yet has a slimline construction, with a height equal to that of the guides.

The carriage housing is preferably in the form of a hermetically sealed, particularly watertight unit that is accessible inside the drying chamber for a clean-in-place (CIP) process.

A second carriage is also provided, which performs a counterbalancing function and is otherwise constructed identically, and which is also accommodated in the guides. Both carriages may have a park position on the loading and unloading device, and in the shift level it is always possible for one of the two carriages to be brought into a pushing position and the other to be brought into a position suitable for providing the counterbalancing function. It may be advantageous to implement the counterbalancing function for drying receptacles that are rather unstable in the upright position.

The guides designed to support the carriage. They are constructed with lengthwise segmentation and are displaceable relative to one another. At the same time, they may also be designed as lateral leading edges for the drying receptacles, so that in conjunction with an additional, displaceable arrangement vertical to the longitudinal extension thereof they can easily be adapted to drying receptacles of different dimensions, thereby also providing such receptacles with secure upright support transversely to an insertion or ejection operation, and at the same time preventing jamming or wedging, and thus ensuring that less waste is created among the drying receptacles.

Depending on the shape of the drying receptacles, e.g., when drying dishes, a gap corresponding to the space requirement for suspending the product platforms may be left between the guides. Consequently, the guides do not necessarily have to be advanced until the frontal faces are flush with each other. As was indicated in the preceding, the carriage is also able to bridge gaps between segments in the guides to some degree.

Gear units enclosed in vacuum-tight capsules that are connected to drive units outside the drying chamber are provided for moving the guide segments. In general, the displacement movement of said segments may also be engineered differently, for example it may be connected to the drive unit of the carriage. A gap between two segments may also be bridged by moving telescopically extensible intermediate elements into these gaps.

As an alternative to enabling transverse displacement of the guides, special lateral guides may also be provided, which are arranged so as to be movable independently of the guides that are designed to accommodate the carriage.

A structural unit designed as a bearing for the loading and unloading device is provided and is arranged so as to be movable toward and away from the drying chamber, that is to say parallel to the direction of insertion and extraction. This variation may be used particularly advantageously for maintenance purposes. Said structural unit may for example be arranged displaceably on rails.

In the preceding, the freeze-drying system has been described in conjunction with a drying chamber that is loaded and unloaded through a single opening. The object of the invention is also usable in a unit that is designed for reach-through operation and is accordingly provided with two openings positioned opposite one another, with a loading and unloading device allocated to each.

The further refinement of the freeze-drying system applies to the version of a system of supports for the product platform located in the shift level that is known per se. This enables the height of the shift level in the drying chamber to be adjusted independently, and is embodied for example by an arrangement of bolts that are displaceable in the shift level relative to the product platform between an active position, in which a support function is fulfilled, and an inactive position, in which a support function is not fulfilled.

A further object of the invention is to design a method for operating a freeze-drying system according to the invention that enables operation under aseptic conditions by simple means.

BRIEF DESCRIPTION OF THE DRAWINGS

In the following, the invention will be explained in greater detail with reference to the exemplary embodiment represented in the drawing. In the drawing.

DETAILED DESCRIPTION OF SPECIFIC EMBODIMENTS

Figure 1:
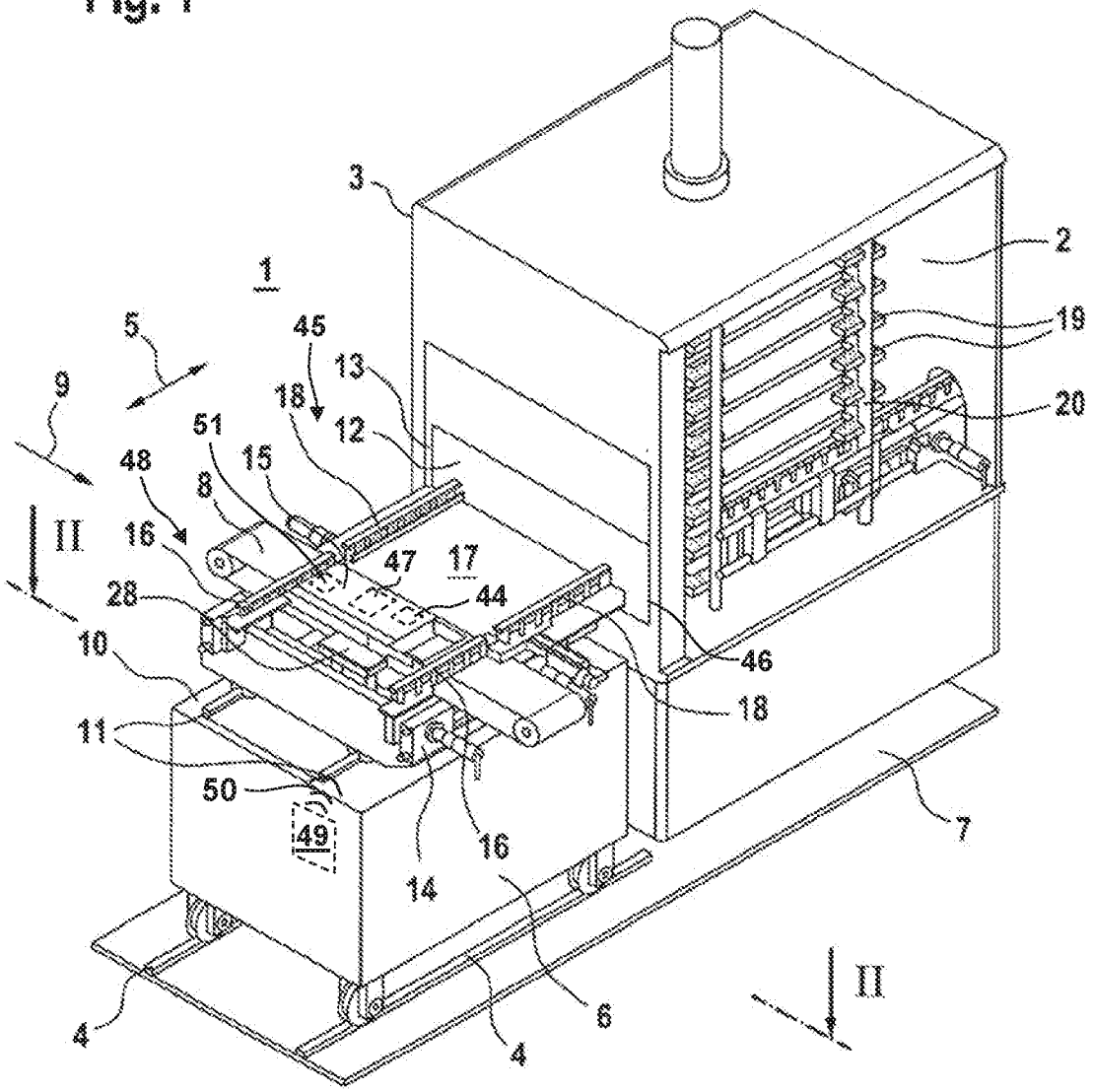
FIG. 1 is a perspective, partial cutaway representation of a freeze-drying system according to the invention.

Reference sign 1 in FIG. 1 designates a freeze-drying system, the main components of which are a drying chamber 2 configured inside a housing 3 and a structural unit 6 that is displaceable on rails 4 in the direction of arrows 5 and supports a loading and unloading device 45. Structural unit 6 together with the rails and housing 3 are mounted on a common base plate 7, and—except during maintenance work—structural unit 6 is normally docked permanently with the housing.

Reference sign 8 designates a conveyor belt, via which drying receptacles containing the substance that is to be freeze-dried may be transported in the direction of arrow 9, that is to say perpendicularly to the direction of arrows 5.

Additional rails 11 are located on the top 10 of the structural unit and are aligned parallel to rails 4 and arrows 5, toward an opening 13 in housing 3 with a closable door 12. Door 12 is opened and closed by a drive unit not shown in the drawing.

A guide unit 14 is supported on rails 11 and displaceable in the direction of arrows 5, and the top of said guide unit in turn supports two guides 16 that are aligned parallel with one another and retain a carriage 15, which will be described in greater detail in the following. Also supported on rails 11 and displaceable in the direction of arrows 5 is a loading stage 17, the top of which also support guides 18 and the function of which will be explained in the following. Carriage 15 is able to travel along guides 16, 18, which are arranged one above the other and constructed identically.

The size and arrangement of guides 16, 18 are determined in conjunction with the displaceability of guide unit 14 and loading stage 17 in the direction of arrows 5, on the basis of the need to ensure that carriage 15 can be moved to a front limit position or loading position on the side of conveyor belt 8 farthest from housing 3.

Drying chamber 2 is equipped in known manner with an arrangement of parallel, horizontal product platforms 19, which are retained so as to be vertically movable in a frame 20, and each serves to support drying receptacles containing a substance to be dried, and which are to be removed from drying chamber 2 when the drying operation is complete.

A height position corresponding to the loading and unloading position of a product platform 19, referred to in the following as the shift level 46, is located inside drying chamber 2, and any of the product platforms can be moved to this shift level. This is the height position inside the drying chamber at which, when door 12 is open, drying receptacles can be inserted in and removed from drying chamber 2 by means of carriage 15, in a manner that will be explained in the following.

Figure 2:
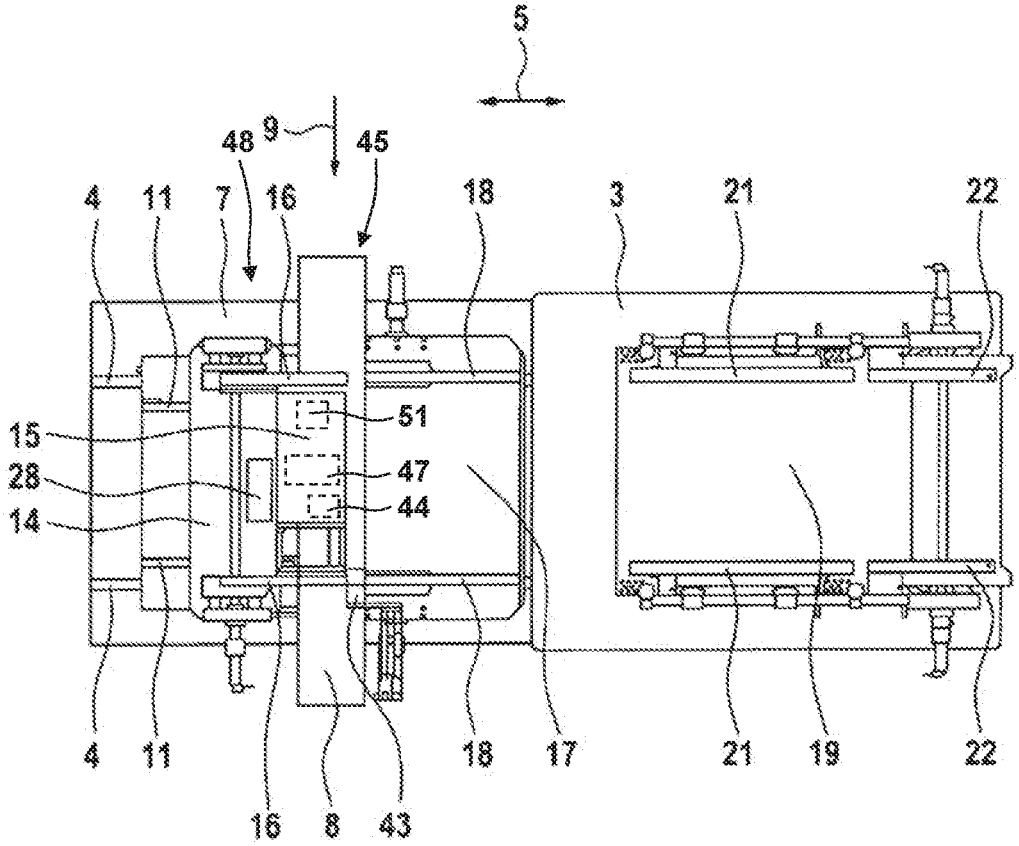
FIG. 2 is a view of the freeze-drying system along a horizontal plane II-II in FIG. 1.

In FIG. 2 and all subsequent figures of the drawing, matching functional elements are denoted with corresponding reference numbers, so to that extent repeated descriptions may be avoided.

Figure 3:
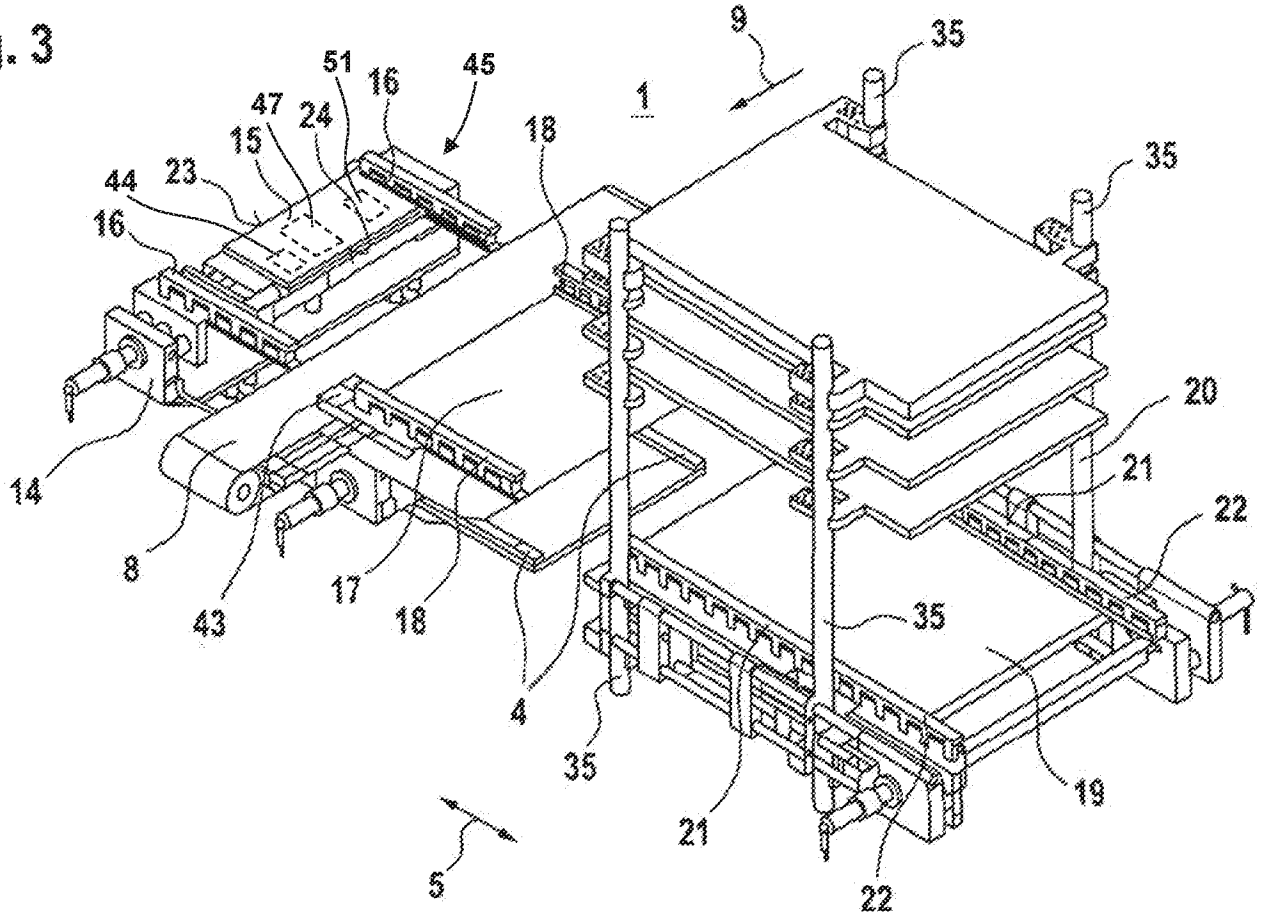
FIG. 3 is a perspective representation of the freeze-drying system of FIG. 1 with the housing removed.

The plan view according to FIG. 2 and the diagram in FIG. 3 show a support plate 19 in the loading position. Further guides 21, 22, which exactly match the construction of guides 16, 18, are also located on this shift level. Consequently, when guide unit 14 and loading stage 17 are moved, a travel range can be created for carriage 15 that starts at the front limit position 48 described in the introduction and extends as far as the rear limit position 52 inside housing 3, the unloading position, by moving guides 21, 22 together. Guides 21, 22 are arranged so as to be displaceable lengthwise inside housing 3, but the height position thereof is fixed unalterably.

Figure 4:
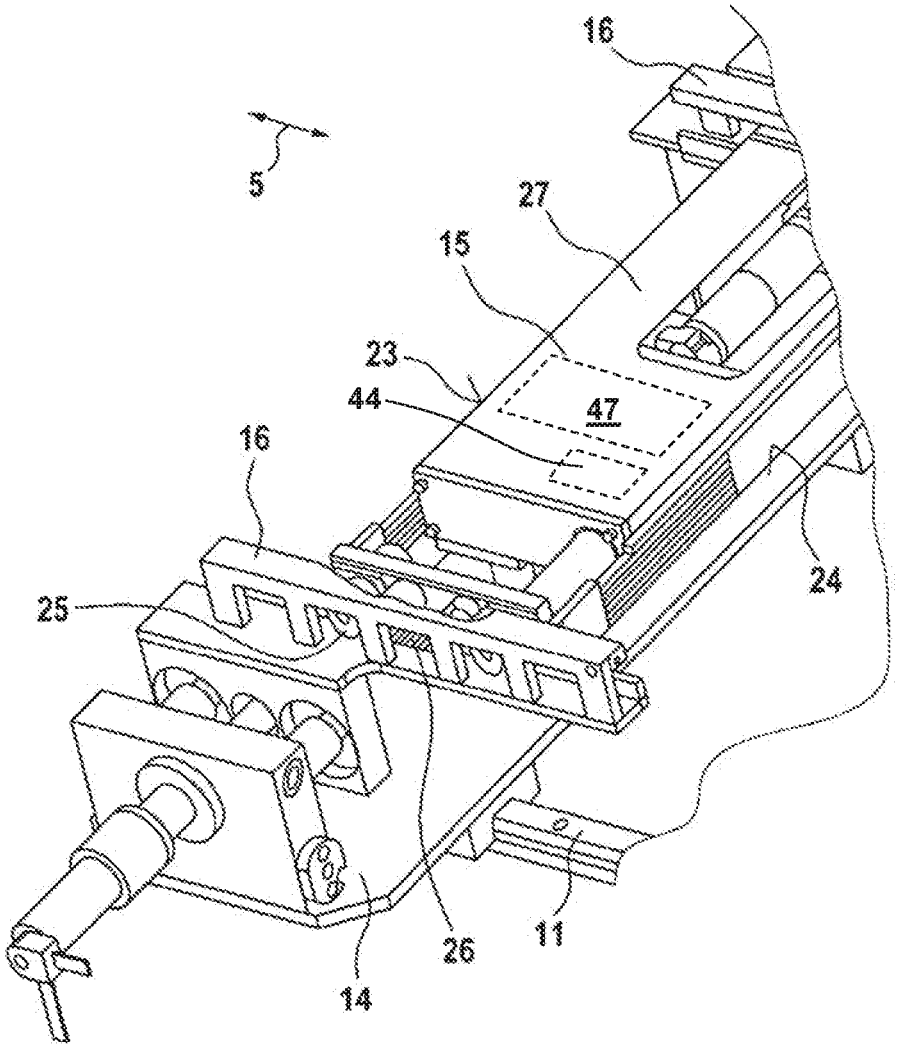
FIG. 4 is an enlarged perspective view of a part of the carriage used as a component of the freeze-drying system of FIG. 1 for pushing the products into and out of the unit.

Carriage 15, shown in FIG. 4, is retained laterally in guides 16, and is characterized on the front 23 thereof, and on the rear 24, that is to say the opposite end in the direction of arrows 5, by identical guide surfaces, which are designed to lie flush against the drying receptacles to be pushed in and out of the device. The support for carriage 15 in guides 16 is assured by running wheels 25, which are connected to each other by a toothed belt 26, wherein toothed belt 26 is also furnished with an outer tooth system, which engages with a corresponding profile on guides 16 and other guides 18, 21, 22. All drive and control components of carriage 15 are accommodated in a slimline housing 27, which is approximately the same height as guides 16, and thus lower than the height of a drying receptacle.

In particular, a battery-powered electric drive unit 47 may be installed in carriage 15, wherein a contactless, e.g. inductive charging station 28 is provided at the charging point to charge the battery 44. (FIG. 1)

In order to ensure that the drying receptacles are retained securely in an upright position, the width of the area available on which the receptacles are to stand must be equal to an integral multiple of the diameter or a comparable dimension of a drying receptacle. In addition, the individual rows of drying receptacles that are pushed onto loading stage 17 must be positioned with an offset of half a diameter with respect to each other to achieve optimum packing density. In this way, a mutual support effect may be achieved among the drying receptacles.

Figure 5:
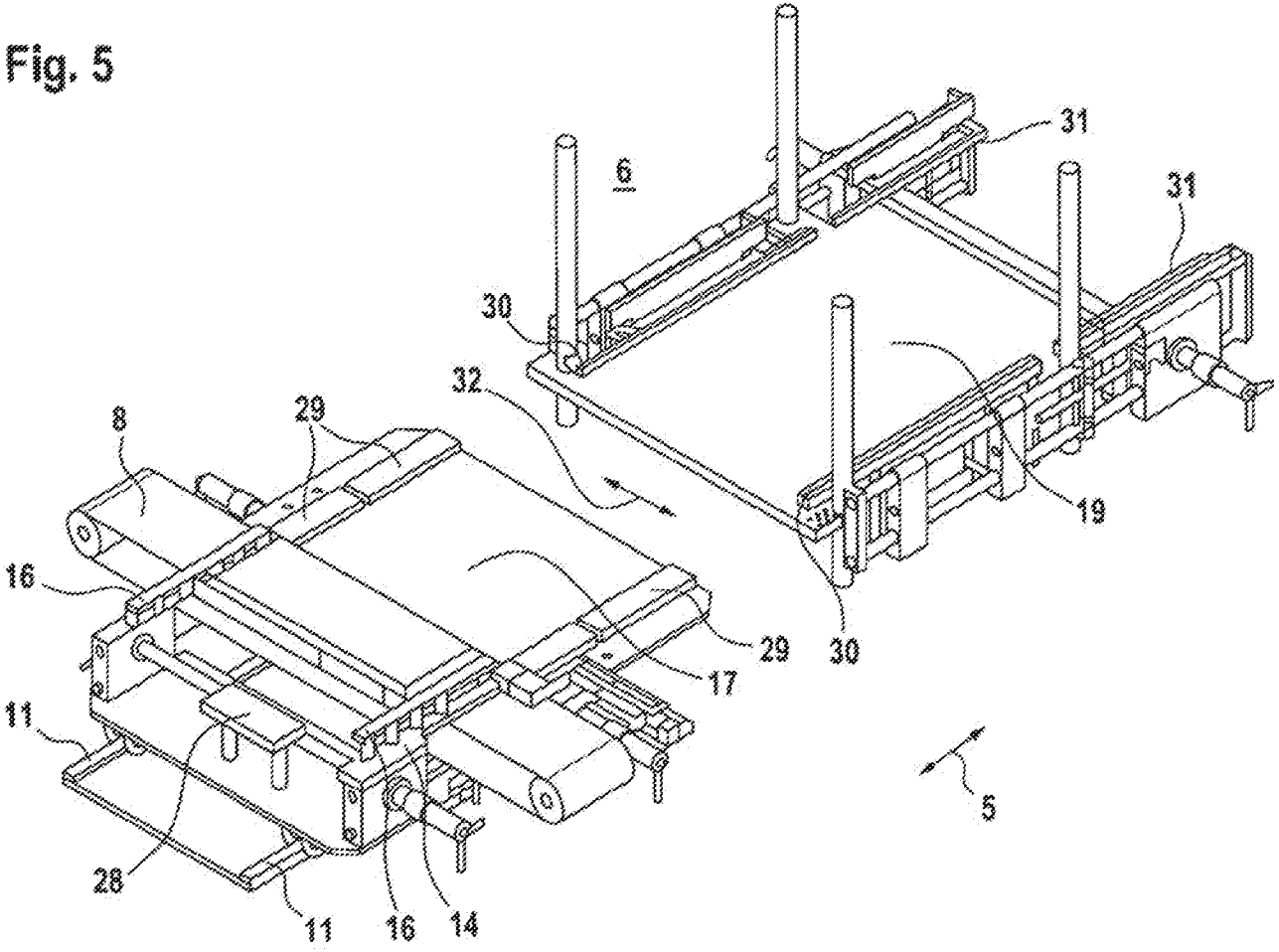
FIG. 5 is a perspective view of part of the lateral guides of the drying receptacles of the freeze-drying system of FIG. 1.

For this purpose, as shown in FIG. 5 loading stage 17 is equipped with lateral guides 29 and product platform 19 is equipped with lateral guides 30, 31. These each form lateral guidance edges for the drying receptacles and are arranged so as to be displaceable transversely to the insertion direction, that is to say in the direction of arrows 32, thus enabling adjustment to different drying receptacle dimensions in this respect. Lateral adjustment of lateral guides 29 to 31 is assured by drive units.

One product platform 19 is always located in the shift level, the method for ensuring this is described in the following with reference to FIGS. 6 to 10.

The corner areas of every rectangular product platform 19 are furnished with protruding lugs 33, which are also rectangular and project in the plane of the respective product platform 19, and each lug has a roughly semicircular cutout 34 that is open toward the peripheral exterior. Said cutouts 34 combine with vertically aligned rods 35 of frame 20 to provide vertical guidance for product platforms 19. In this way, precise vertical guidance is assured for product platforms 19.

Reference numerals 36, 37 designate carriages that are connected to one another and are displaceable by motor in a direction parallel to arrows 5, and are connected to the respective guides 21, 22. In this way it is possible for guides guided 21, 22 to be displaced lengthwise between two lugs 33 in each case within cutouts 38.

Figure 6:
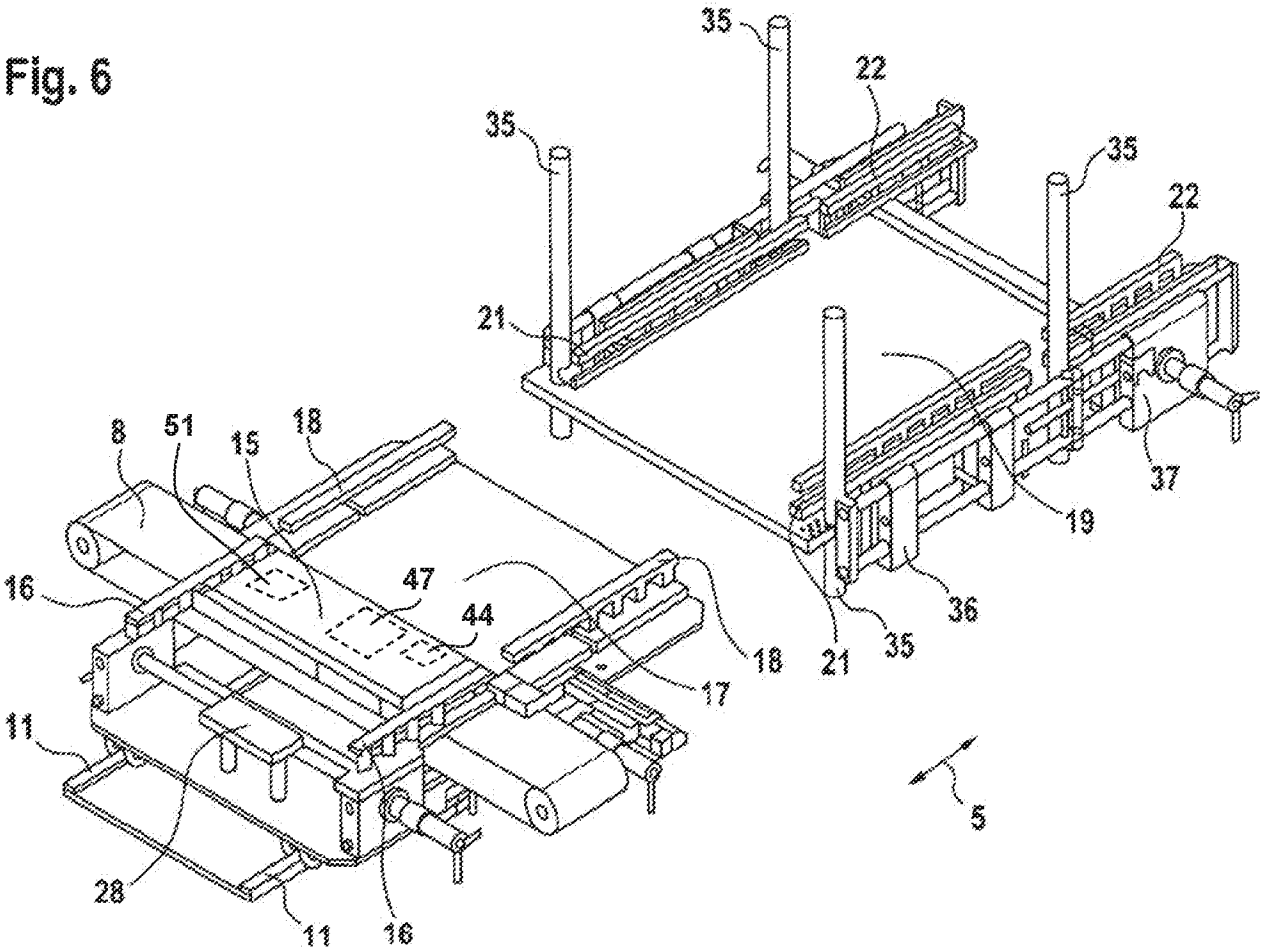
FIG. 6 is a perspective view of part of the carriage guides of the freeze-drying system of FIG. 1.

The lengthwise displaceability of guides 21, 22 that is made possible in this way is subject to the limitation that in a first limit position shown in FIG. 6 the opposing frontal faces of two consecutive guides 21, 22 are at a distance from one another, whereas in a second limit position the same frontal faces are in flush contact with one another, thus forming a continuous, practically constant guide segment for carriage 15.

Figure 7:
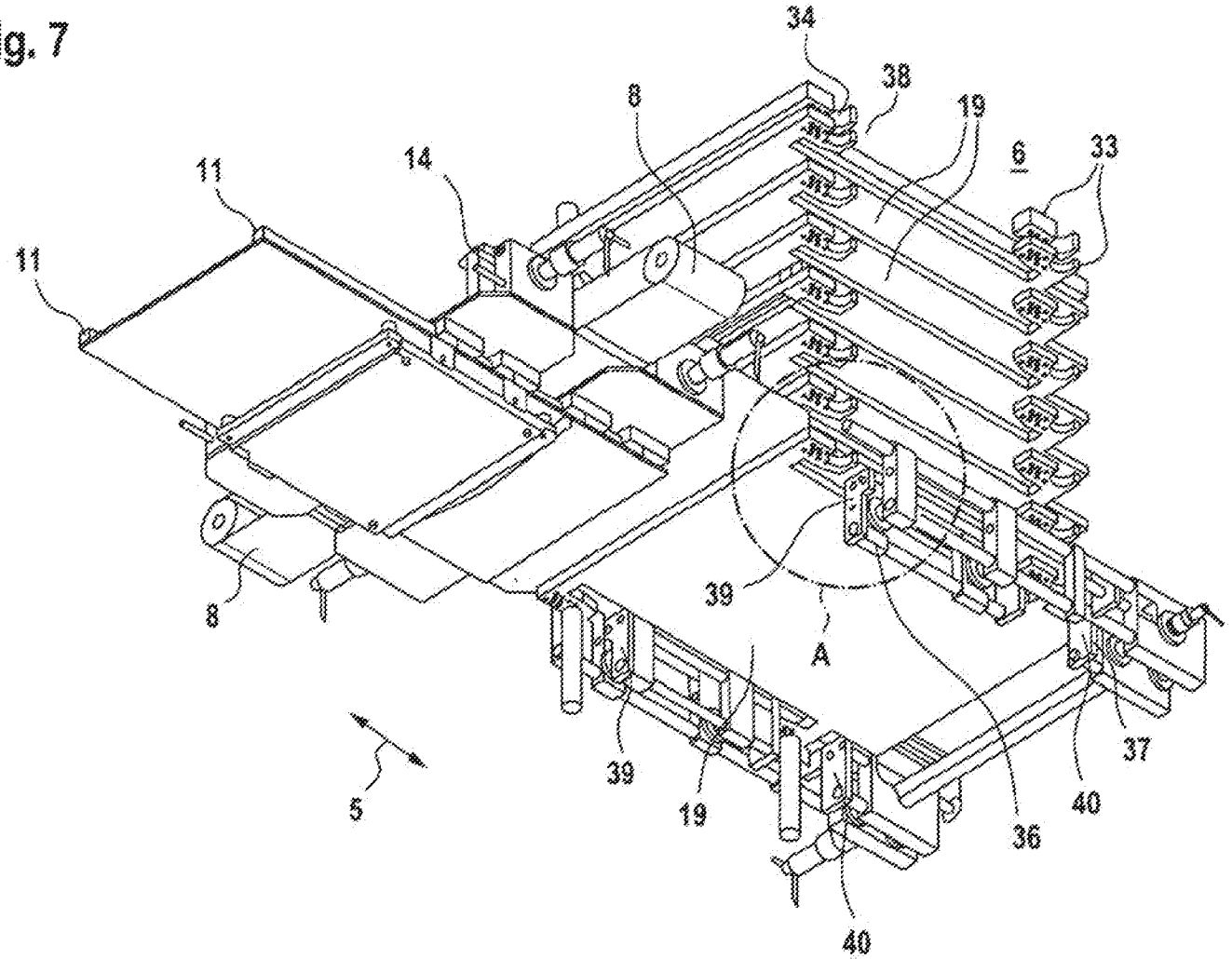
FIG. 7 is a perspective partial view of the underside of the freeze-drying system of FIG. 1.

The first limit position is characterized in that product platforms 19 are freely displaceable in the vertical direction. The second limit position is characterized in that one product platform 19 is located in the loading and unloading position or shift level described in the introduction, and is secured therein in positive locking manner. For this purpose, the end plates 39, 40 (FIG. 7, 8) of carriages 36, 37 shown on the left in FIG. 7 are equipped with horizontally aligned bolts 41 that have a bearing function.

Figure 8:
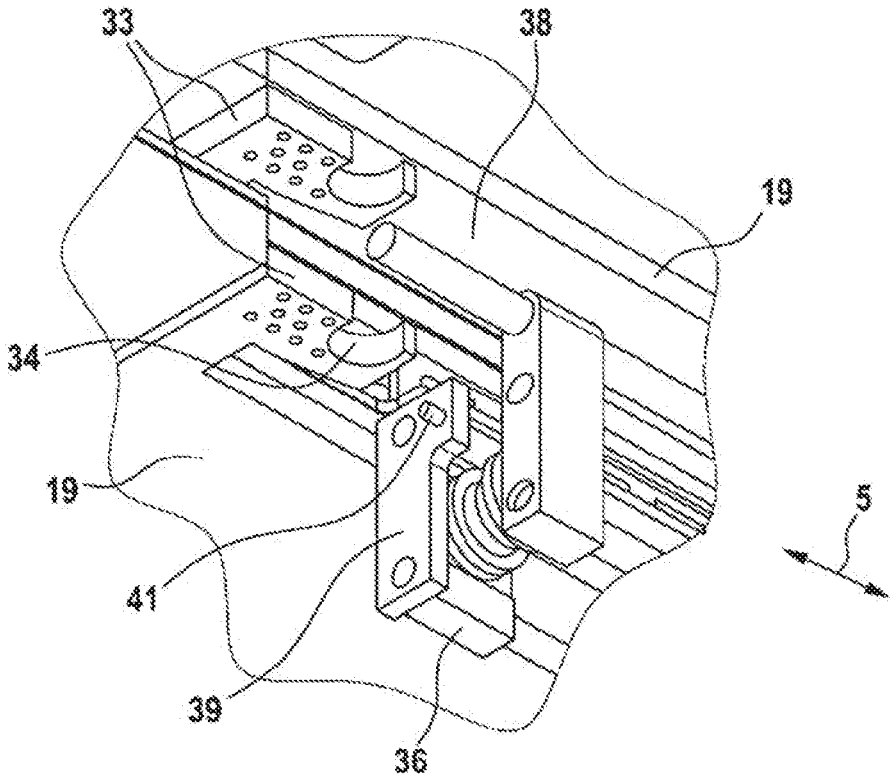
FIG. 8 is an enlarged view of part of a single unit A of FIG. 7.
Figure 9:
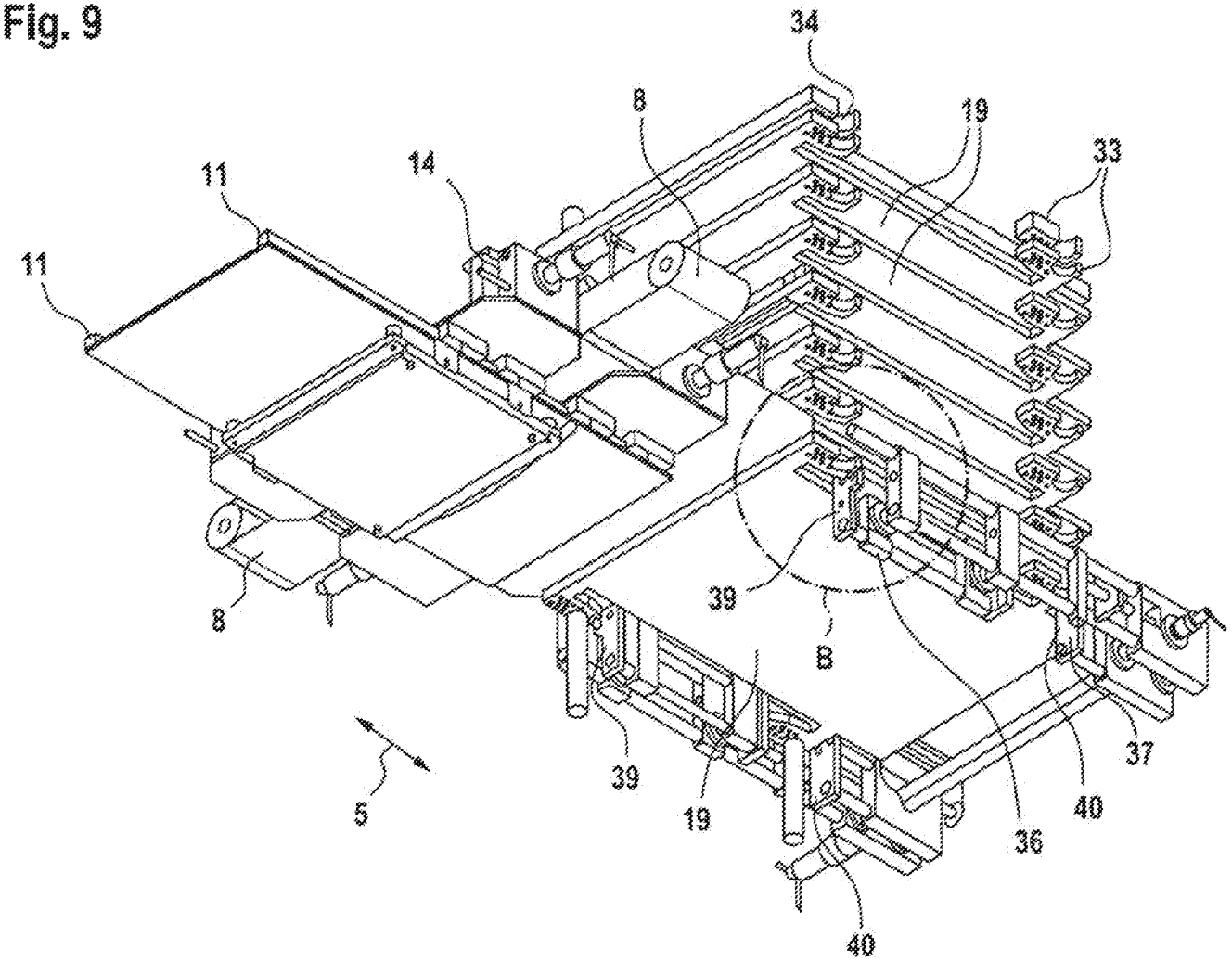
FIG. 9 is a perspective partial view of the underside of the freeze-drying system of FIG. 1.
Figure 10:
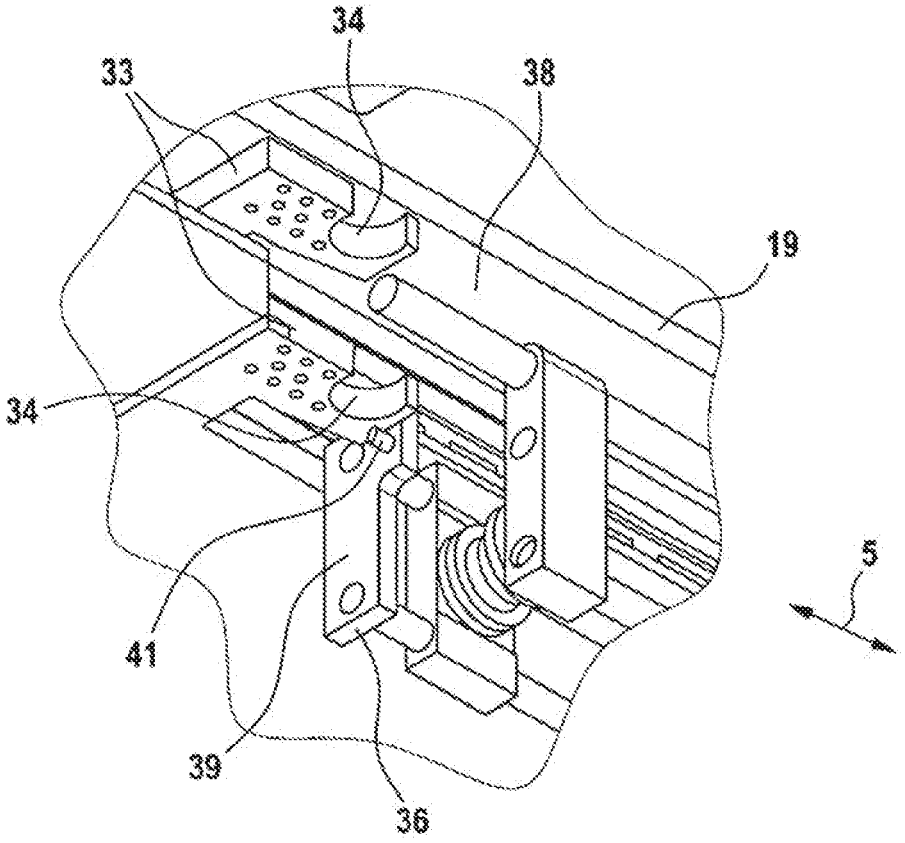
FIG. 10 is an enlarged view of part of a single unit B of FIG. 9.

FIG. 8 shows carriage 36 in the first limit position, wherein it is evident that a vertical movement of product platforms 19 is not prevented by bolt 41. On the other hand, FIG. 10 shows the carriage in the second limit position, in which it is shown that a section of a lug 33 facing bolt 41 rests on bolt 41, thus preventing support plate 19 for descending any further. In the following, the movement sequences in a work cycle of freeze-drying system 1 will be described with reference to FIGS. 11 to 17, starting with drying receptacles being pushed into the freeze-drying system one row at a time, and ending with the drying receptacles being pushed out of the system after the drying operation is completed.

Figure 11:
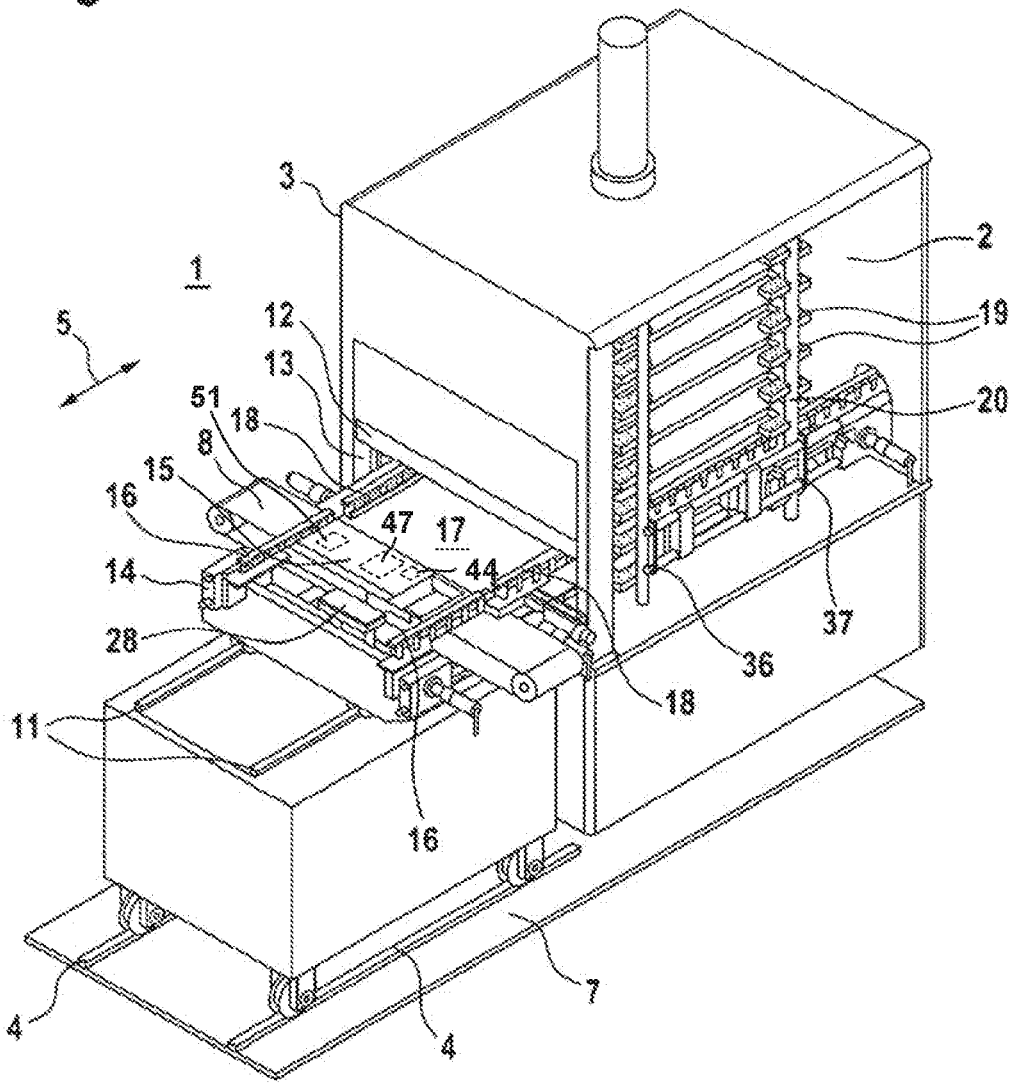
FIGS. 11 to 17 each represent consecutive operating phases of the freeze-drying system of FIG. 1, beginning with the opening of the housing door until the ejection of a group of drying receptacles at the end of a drying treatment.
Figure 12:
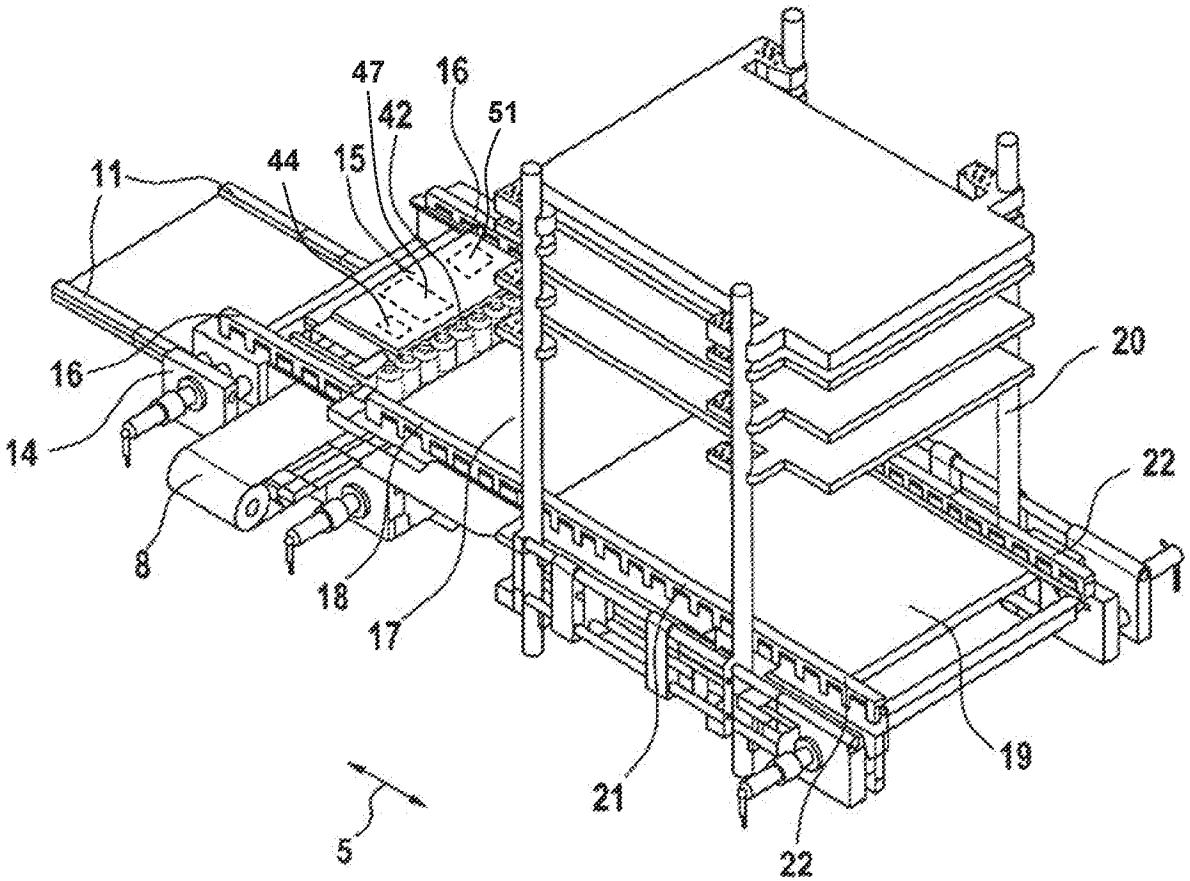
Figure 13:
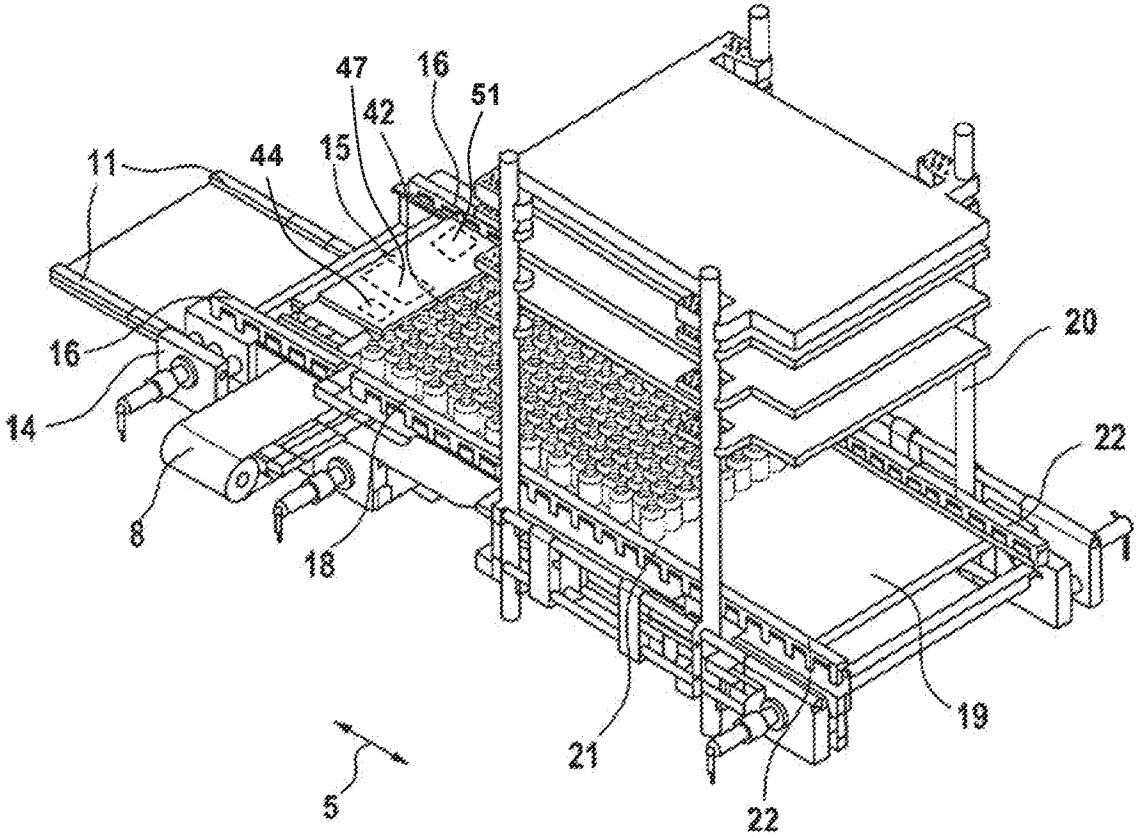

As shown in FIG. 11, door 12 of housing 3 has been moved into the opening position thereof, wherein, as shown in FIG. 12, guides 21, 22 have been shifted to the second limit position thereof, and the frontal faces thereof are thus abutting and forming a continuous guide for carriage 15 inside drying chamber 2.

Guidance unit 14 is also displaced together with loading stage 17 in the direction of arrows 5, with the qualification that loading stage 17 and thus also guides 18 thereof lie flush with the front faces of guides 21 inside drying chamber 2, so that loading stage 17 has been moved partly inside drying chamber 2.

In this starting position, a first row of drying receptacles 42 is transported via conveyor belt 8 to a position in front of carriage 15, which is thus located on the side of conveyor belt 8 farthest from housing 3.

Figure 14:
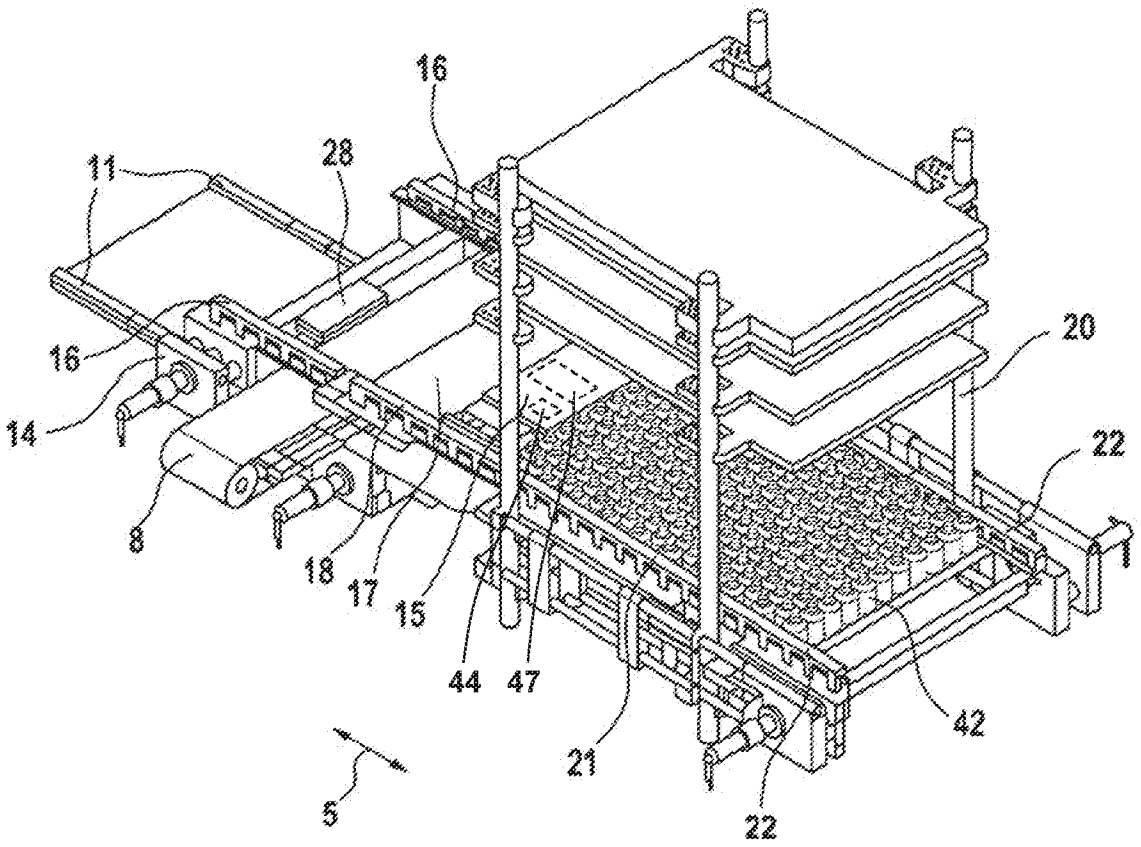

As rows of drying receptacles 42 are brought into position cyclically thereafter via conveyor belt 8, possibly with the respective withdrawal of guidance unit 14 on rails 11 towards housing 3, said rows are pushed by carriage 15 one after the other over loading stage 17 and onto the product platform 19 that is initially in the topmost position of the plurality of product platforms 19 in the drying chamber 2, until the number of drying receptacles 42 in the chamber is equal to the holding capacity thereof. In this process, the placement of the drying receptacles is carried out in known manner with the qualification that consecutive rows in the direction of insertion are positioned with a vertical offset relative to this direction due to timed transverse shifting by means of a shifter 43, so that optimum packing density is achieved. This state of full loading of the product platform 19 in the loading position is shown in FIG. 14.

Figure 15:
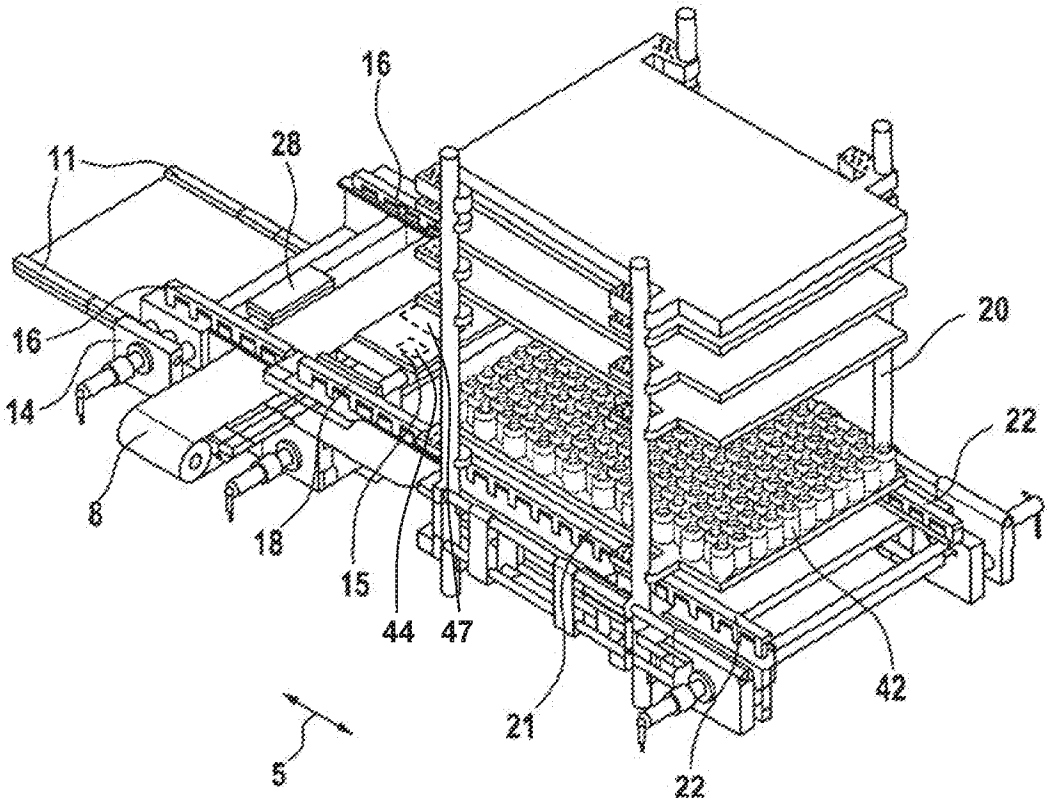

The loaded product platform 19 shown in FIG. 15 is thus raised relative to its position in FIG. 14 to such a degree that now another product platform 19 is in the loading position below the first platform, and the operation of loading in rows can continue until the loading state of drying chamber 2 is complete.

As shown in FIG. 15, carriage 15 is then moved backward, that is to say away from the last product platform 19, wherein this operation is repeated after the next product platform 19 is shifted into the loading position until all product platforms 19 down to the one that was originally at the bottom are fully loaded, and after loading stage 17 has been withdrawn from drying chamber 2 and door 12 has been closed, the freeze-drying process may be carried out in known manner.

Figure 16:
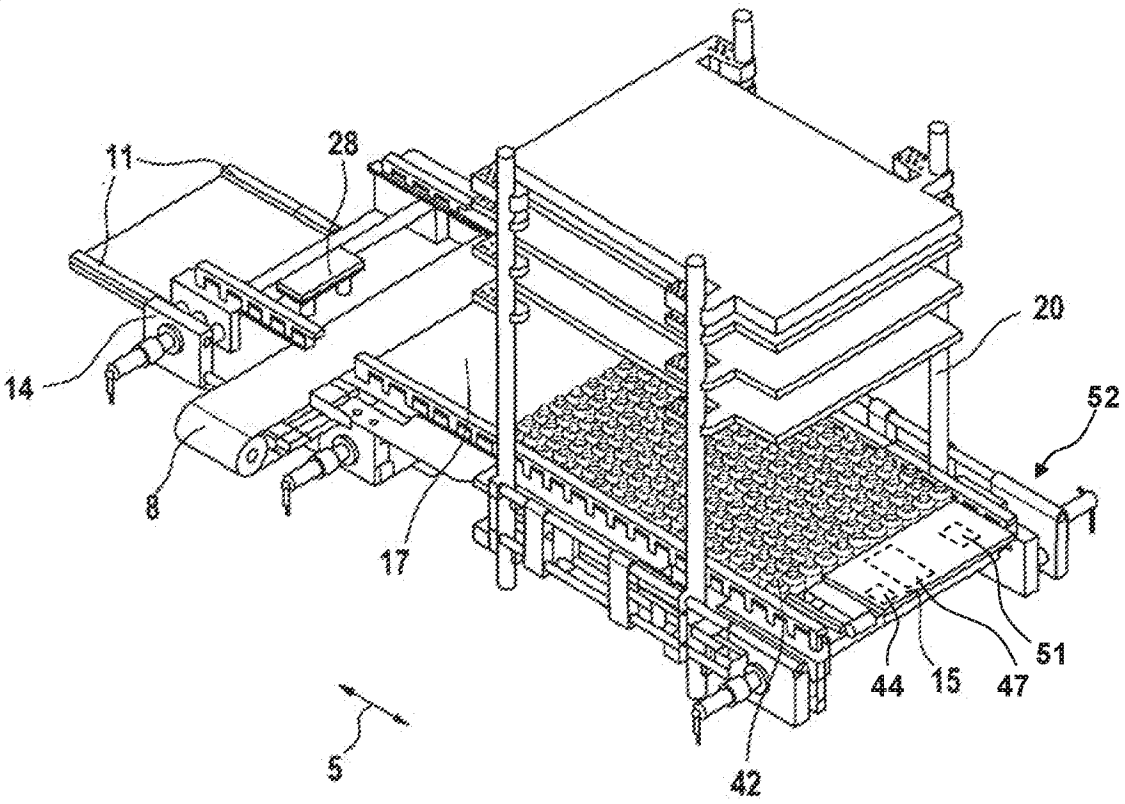
Figure 17:
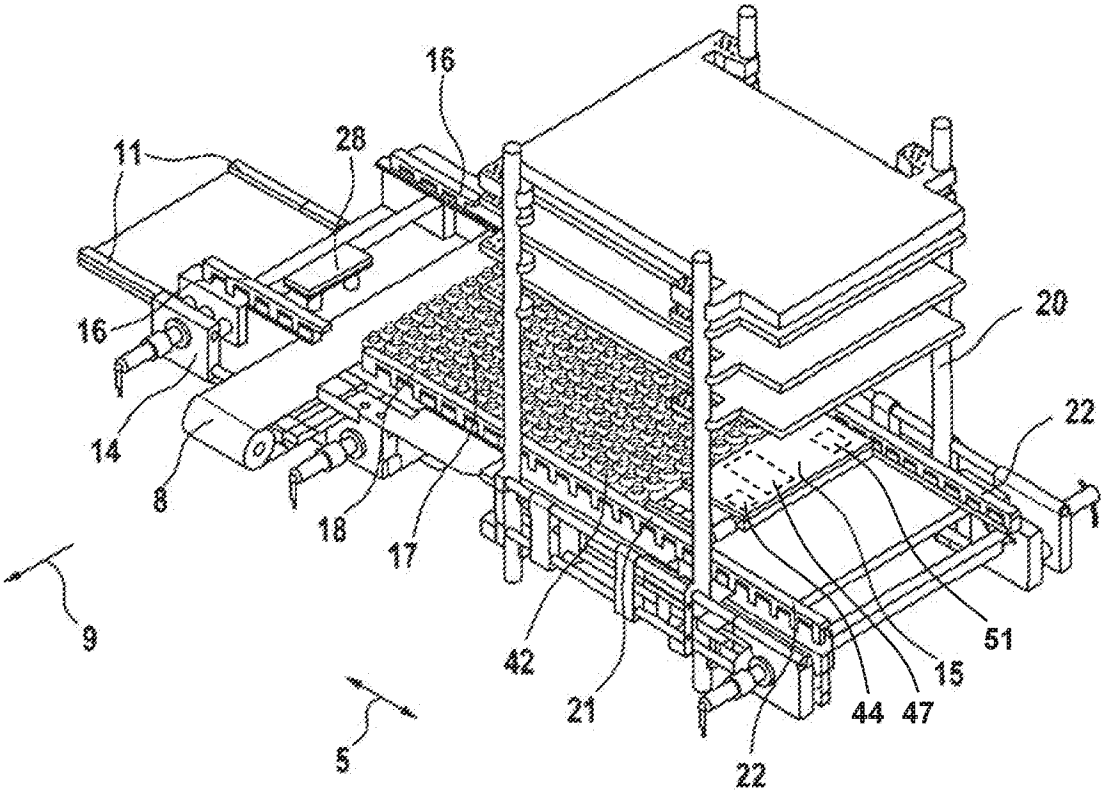

After the freeze-drying process is completed, an empty rack level is established in the loading position that corresponds to the unloading position, that is to say below the loaded product platforms 19, possibly after the vertical shift thereof, and then after door 12 is opened and guide unit 14 is shifted and loading stage 17 is advanced into drying chamber 2, guides 18, 21, 22 are moved toward each other in the lengthwise direction thereof, thus again creating a continuous displacement path for carriage 15. The carriage is then advanced into this empty rack level, thus in the process travelling underneath the loaded product platforms 19, until it reaches its rear limit position opposite door 12 inside drying chamber 2. Then, the loaded product platform 19 positioned immediately above the originally empty rack level is lowered into the shift level, and is secured in this position in positive locking manner by shifting of guides 16, 18 to the second limit position thereof. Carriage 15 is now located behind the group of drying receptacles 42, which is opposite door 12. This position of the carriage is shown in FIG. 16.

Carriage 15 is now actuated in order to push the drying receptacles across loading stage 17 onto conveyor belt 8, on which drying receptacles 42 that have undergone freeze-drying treatment are carried away in the direction of arrow 9.

After the bottom product platform 19 has been emptied, carriage 15 is then moved back into drying chamber 2 again, along product platform 19 that is now empty, until it reaches its rear end position, travelling under the next product platform 19 that is to be unloaded. This product platform is then lowered into the unloading position and secured therein by positive locking means, at which point the unloading process is continued with carriage 15 and conveyor belt 8 working together. Product platforms 19 are thus unloaded one after the other by means of just a single carriage, and carriage 15 always travels below product platforms 19 that are still loaded, thereby ensuring in this respect that aseptic conditions are reliably maintained.

The specification incorporates by reference the disclosure of German patent application DE 10 2011 117 628.8, filed Nov. 4, 2011, as well as PCT/EP2012/004595, filed Nov. 3, 2012.

The present invention is, of course, in no way restricted to the specific disclosure of the specification and drawings, but also encompasses any modifications within the scope of the appended claims.

LIST OF REFERENCE SIGNS

| | |
|---|---|
| 1 | Freeze-drying system |
| 2 | Drying chamber |
| 3 | Housing |
| 4 | Rails |
| 5 | Arrows |
| 6 | Structural unit |
| 7 | Base plate |
| 8 | Conveyor belt |
| 9 | Arrow |
| 10 | Top |
| 11 | Rails |
| 12 | Door |
| 13 | Opening |
| 14 | Guide unit |
| 15 | Carriage |
| 16 | Guide |
| 17 | Loading stage |
| 18 | Guide |
| 19 | Product platform |
| 20 | Frame |
| 21 | Guide |
| 22 | Guide |
| 23 | Front |
| 24 | Rear |
| 25 | Running wheel |
| 26 | Toothed belt |
| 27 | Housing |
| 28 | Loading unit |
| 29 | Lateral guide |
| 30 | Lateral guide |
| 31 | Lateral guide |
| 32 | Arrows |
| 33 | Lug |
| 34 | Cutout |
| 35 | Rod |
| 36 | Carriage |
| 37 | Carriage |
| 38 | Cutout |
| 39 | End plate |
| 40 | End plate |
| 41 | Bolt |
| 42 | Drying receptacle |
| 43 | Shifter |
| 44 | Battery |
| 45 | Loading and unloading device |
| 46 | Shift level |
| 47 | Drive unit |
| 48 | front limit position |
| 49 | Control device |
| 50 | Radio link |
| 51 | Controller |
| 52 | Rear limit position |

The invention claimed is:

1. A freeze-drying apparatus (1), comprising:

a drying chamber (2) accommodated inside a housing (3);

an arrangement of product platforms (19) disposed so as to be displaceable vertically in a frame (20) and designed to support drying receptacles (42) containing a substance to be dried, located inside the drying chamber (2), wherein the housing (3) has at least one opening (13) that is closable by a door (12);

a loading and unloading device (45) for the drying receptacles (42) outside of the drying chamber (2); and a carriage (15) that is supported by guides (16,18, 21, 22), a structure of the carriage comprising a front side that forms a front leading edge (23) of the carriage (15) and a back side that forms a back leading edge (24) of the carriage (15), wherein the carriage (15) is configured to push the drying receptacles (42) into the drying chamber (2) using the back leading edge (24) of the carriage (15), wherein the arrangement of product platforms (19) is liftable vertically inside the drying chamber (2), such that the carriage (15) advances by travelling under loaded product platforms (19), thus avoiding travelling directly or indirectly over the loaded product platforms (19), as far as a rear limit position in the drying chamber (2), wherein after a respective next higher loaded product platform (19) is lowered, the drying receptacles (42) are moveable out of the drying chamber (2) through the opening (13) using the front leading edge (23) of the carriage (15).

2. The freeze-drying apparatus according to claim 1, wherein the carriage (15) advances in a shift level which is defined in the drying chamber (2) by a fixed height position of the guides (16, 18, 21, 22).

3. The freeze-drying apparatus (1) according to claim 2, further comprising an arrangement of supports defined by bolts (41) for the product platform in the shift level, so that the height position of the product platform (19) located in the shift level is ascertainable independently of the frame (6), wherein the system of supports is movable between an active position that reaches under the product platform (19) in the shift level and an inactive position that does not reach under the product platform.

4. The freeze-drying apparatus (1) according to claim 1, wherein the loading and unloading device comprises a conveyor belt (8), wherein a direction of advance of said conveyor belt (8) runs transversely to a direction in which the drying receptacles (42) are pushed into or pushed out of the drying chamber (2).

5. The freeze-drying apparatus (1) according to claim 1, wherein the loading and unloading device comprises a loading stage (17) that supports the guides (18) and is advanceable into the drying chamber (2) to connect with the guides (21) therein.

6. The freeze-drying apparatus (1) according to claim 1, wherein a front limit position (48) of the carriage (15) is arranged on the loading and unloading device.

7. The freeze-drying apparatus (1) according to claim 6, wherein the front limit position is located on a side of a conveyor belt (8) opposite the drying chamber (2).

8. The freeze-drying apparatus (1) according to claim 1, wherein the carriage (15) is equipped with a drive unit (47).

9. The freeze-drying apparatus (1) according to claim 8, further comprising an electrical drive unit (47), wherein the electrical drive unit is supplied with power and/or controlled via the guides (16, 18,21, 22).

10. The freeze-drying apparatus (1) according to claim 8, further comprising a battery-powered electrical drive unit and by a charging station (28) set up outside the drying chamber (2).

11. The freeze-drying apparatus (1) according to claim 8, further comprising an electrical drive unit and a radio link (50) established between the drive unit (47) and a control device (49) located outside the drying chamber (2) to control the drive unit.

12. The freeze-drying apparatus (1) according to claim 8, wherein the drive unit is in non-positive locking connection with the guides (16,18,21,22) via a toothed belt with double-sided profiling, transmitting a motion in the pushing in or a pushing out direction, into and out of the drying chamber (2).

13. The freeze-drying apparatus (1) according to claim 8, wherein the carriage (15) is a slimline structural unit accommodating the drive unit and a controller (51) thereof, wherein a structural height of said carriage does not exceed that of the guides (16,18, 21, 22).

14. The freeze-drying apparatus (1) according to claim 1, wherein the guides (16, 18, 21, 22) are segmented longitudinally and are arranged so as to be movable between a position in which frontal faces abut each other and a position in which a gap is left between the frontal faces.

15. The freeze-drying apparatus (1) according to claim 1, wherein the guides are arranged so as to be movable horizontally with respect to a lengthwise extension of said guides while preserving the mutually parallel alignment.

16. The freeze-drying apparatus (1) according to claim 1, further comprising lateral guides (29, 30, 31) for the drying receptacles (42) to be pushed into and out of the drying chamber (2), wherein said lateral guides (29, 30, 31) are arranged so as to be displaceable horizontally to the direction of pushing in or out.

17. The freeze-drying apparatus (1) according to claim 1, wherein the loading and unloading device is supported on a structural unit (6) that is arranged so as to be movable away from the drying chamber (2) and toward said drying chamber.

18. The freeze-drying apparatus (1) according to claim 1, further comprising the housing (3) that accommodates the drying chamber (2) with the opening (13) having the closable door (12) and the loading and unloading device respectively on opposite sides thereof.

19. The freeze-drying apparatus (1) according to claim 1, operated using a method comprising the steps of:

in order to load the drying chamber (2), pushing forward the drying receptacles (42) containing the substance to be dried onto a respective one of the product platforms (19) to be loaded in the shift level one row at a time using the back leading edge (24) of the at least one carriage (15), until the loading operation for the respective one of the product platforms (19) is completed, wherein the loading operation of each subsequent one of the product platforms (19) is continued by cyclical moving of each subsequent one of the product platforms (19) into the shift level until loading of the drying chamber (2) is completed;

in order to unload the drying chamber (2) after completion of the drying process, advancing the carriage (15) into the drying chamber (2) as far as it rear limit position (52) in the shift level by travelling underneath the loaded product platforms (19);

lowering the respective one of the product platforms (19) to the shift level after the carriage has travelled beneath it; and pushing out the drying receptacles (42) standing upright on the respective one of the product platforms (19) in the shift level through the opening (13) by the front leading edge (23) of the carriage (15), wherein the steps of advancing the carriage (15) into the drying chamber (2) as far as the rear limit position on the shift level by travelling below each successive loaded product platform (19) located above the shift level, lowering the located product platform (19) to the shift level, and pushing the drying receptacles (42) out through the opening (13) are repeated cyclically until the process of unloading the drying chamber (2) is completed.

20. A freeze-drying apparatus (1), comprising:

a drying chamber (2) accommodated inside a housing (3);

an arrangement of product platforms (19) disposed so as to be displaceable vertically in a frame (20) and designed to support drying receptacles (42) containing a substance to be dried, located inside the drying chamber (2), wherein the housing (3) has at least one opening (13) that is closable by a door (12);

a loading and unloading device (45) for the drying receptacles (42) outside of the drying chamber (2), which has a carriage (15) that is supported by guides (16,18,21, 22), and is configured to push the drying receptacles (42) into the drying chamber (2) by means of a back side (24), wherein said back side (24) forms a first movable leading edge, wherein at least one horizontal shift level (46) is defined by a height position of the opening (13), wherein the guides extend into said opening (13) and assume a fixed height position, wherein the arrangement of product platforms (19) is displaceable vertically inside the drying chamber (2), such that the carriage (15) advances in the shift level by travelling under loaded product platforms (19), thus avoiding travelling directly or indirectly over loaded product platforms (19), as far as a rear limit position in the drying chamber (2), wherein after a respective next higher loaded product platform (19) is lowered into the shift level, the drying receptacles (42) are moveable out of the drying chamber (2) through the opening (13) using a front side (23) of the carriage (15), wherein said front side (23) forms a second movable leading edge; and an arrangement of supports defined by bolts (41) for a product platform in the shift level, wherein the arrangement of supports allows vertical displacement of platforms (19) independently of the frame (6), wherein the arrangement of supports is movable between a first position that reaches under the product platform (19) to support the product platform using the bolts (41) and a second position that does not reach under the product platform.

* * * * *